US012319454B2

(12) United States Patent
Derendinger et al.

(10) Patent No.: US 12,319,454 B2
(45) Date of Patent: Jun. 3, 2025

(54) FEEDING DEVICE FOR SEALER

(71) Applicant: FERRUM PACKAGING AG, Schafisheim (CH)

(72) Inventors: Philippe Derendinger, uml a+ee gendorf (CH); Jörn Winkelmann, Barmstedt (CH)

(73) Assignee: Ferrum Packaging AG, Schafisheim (CH)

( * ) Notice: Subject to any disclaimer, the term of this patent is extended or adjusted under 35 U.S.C. 154(b) by 0 days.

(21) Appl. No.: 18/218,515

(22) Filed: Jul. 5, 2023

(65) Prior Publication Data

US 2024/0025586 A1 Jan. 25, 2024

(30) Foreign Application Priority Data

Jul. 19, 2022 (EP) ..... 22185613

(51) Int. Cl.
*B65B 1/00* (2006.01)
*B65B 31/04* (2006.01)

(52) U.S. Cl.
CPC ..... *B65B 31/046* (2013.01)

(58) Field of Classification Search
CPC ... B65B 31/046; B65B 25/067; B65B 31/028; B65B 31/00; B65B 7/164; B65B 1/02; B65B 2220/18; B65B 3/02; B65B 43/10; B65D 81/2076; B65D 81/264; B65D 21/062; B65D 21/066; B65D 81/267
USPC ..... 53/369, 510, 432, 471, 281, 282
See application file for complete search history.

(56) References Cited

U.S. PATENT DOCUMENTS 2,330,598 A 9/1943 Kronquest
2,950,587 A * 8/1960 Harmon ..... B67B 3/2053 53/129.1
3,545,160 A * 12/1970 Scott ..... B65B 31/00 53/403
2017/0283102 A1* 10/2017 Strauch ..... B65B 7/28

OTHER PUBLICATIONS

European Search Report issued Jan. 5, 2023 in corresponding European Application No. 22185613.3.

* cited by examiner

*Primary Examiner* — Jacob A Smith
(74) *Attorney, Agent, or Firm* — Global IP Counselors, LLP

(57) ABSTRACT

A feeding device for gassing a container and a lid in a gassing area during feeding to a sealer includes a container feeder for feeding the container through the gassing area along a first feed path, and a lid feeder arranged on the container feeder such that a lid can be moved through the gassing area along a second feed path to the container and can be placed on the container at one end of the gassing area, and a gassing device arranged stationary at the gassing area for gassing the container and the lid in the gassing area.

18 Claims, 8 Drawing Sheets

FEEDING DEVICE FOR SEALER

CROSS-REFERENCE TO RELATED APPLICATION

This application claims priority to European Patent Application No. 22185613.1, filed Jul. 19, 2022, the contents of which are hereby incorporated by reference in its entirety.

BACKGROUND

Technical Field

The disclosure relates to a feeding device and a sealer for sealing a container. The disclosure further relates to a method for gassing a container by a feeding device according to the disclosure.

Background Information

During the filling of beverage cans or food cans, the cans pass through a can sealer after being filled with the beverage or foodstuff, whereby the filled cans enter via a feed path and can lids enter via a further feed path. The can sealer usually has several similar stations arranged in a carousel shape, in each of which a can is sealed with a can lid. The can lids are guided onto the cans and held on the can by a seaming head. This holding also serves to fix the cans against breaking out of the circular path passed by the cans in the can sealer due to the centrifugal force. In the can sealer, the can with the can lid is seamed over a seaming roll at the edges and thus sealed. Normally, the can with the can lid is additionally rotated around its own axis of symmetry by the seaming head. For rotation, the seaming rolls and seaming heads are arranged on a respective seaming shaft or seaming shaft pin.

A generic can sealer is described in DE 749636 and DE 4234115 A1. The can sealer comprises a clamping device for receiving a can to be sealed. In the operating state, the can to be sealed is introduced into the clamping device and secured by the clamping device in the axial and radial directions. A can lid is also introduced centered over the can opening of the can to be sealed. The can has a circumferential can flange in the area of the can opening and the can lid has a circumferential can lid flange. For sealing the can opening with the can lid, the can sealer additionally comprises two seaming rolls, mounted rotatably about an axis in each case, which seaming rolls press the can flange and the can lid flange together by a force acting substantially radially, the pressing being effected by a continuous rolling in the circumferential direction along the circumference of the can opening.

A further can sealer is known from GB 2098899 A. The can sealer comprises a clamping device for receiving the can to be sealed and a seaming roll. In the operating state, the can to be sealed is introduced into the clamping device and secured by the clamping device in the axial and radial directions. A can lid is also introduced centered over the can opening of the can to be sealed. The can has a circumferential can flange in the area of the can opening of the can body and the can lid has a circumferential can lid flange.

In addition, it is known to convey a gas, such as an inert gas, to an underside of the lid during at least a section of the feeding of the lid. The gas is conveyed substantially parallel to the underside of the lid. This underside faces the opening of the can when used as intended. In this way, it can be ensured that a residual volume of the can in which no foodstuff is arranged is substantially filled with the gas before sealing, whereby the air originally present in the residual volume is displaced as completely as possible by the gas. In this way, if necessary, a longer shelf life of the foodstuff arranged in the can can be achieved.

For a better understanding of the subject matter of the present disclosure, a conventional can sealer with feeding device known from the state of the art is described in the following on the basis of FIGS. 1 and 2.

For a better distinction of the known state of the art from the present disclosure, reference signs to features of known devices are provided with an inverted comma (in FIGS. 1 and 2) in the context of this application, whereas features to devices according to the disclosure or their components do not carry an inverted comma.

The conventional can sealer 1000' according to FIGS. 1 and 2 comprises a lid providing device 11' for providing a lid 101', a gassing rotor 4' for supplying gas to the can 100' and for guiding and transporting the lid 101' to the can 100'. In addition, the sealer comprises a seaming process/a carousel-shaped arrangement 14' with seaming stations for sealing the can 100' with the lid 101'. Thereby, the seaming process 14' is arranged in a working space 2' of the can sealer 1000' surrounded by a housing 3'.

The lid 101' is introduced by the lid providing device 11' into the working space 2' of the can sealer 1000' along the arrow C'. In this process, the lids 101' are placed on the gassing rotor 4'. By rotation of the gassing rotor 4', the lids 101 are transported further. Then, the cans 100' are introduced in direction A' by the container feeder 12' into the container receptacles 17' of the gassing rotor 4'. There, the container 100' is grassed in area B with a gas such as carbon dioxide or nitrogen and combined with the lid 101'.

The gassing is carried out along the arrow D' by a gas supply 16' via the gassing rotor 4' by nozzles which are provided in each container receptacle 17'. The gas is guided to a gas control ring 25' at the gassing rotor 4'. On the one hand, this serves as a slip ring for rotary feedthrough, on which the gassing rotor 4' rotates. On the other hand, the gas control ring 25' serves as a valve so that only the nozzles in the gassing area B' are active.

After gassing, the container 100' with the lid 101' is moved on by the container transfer 13' from the gassing rotor 4' to the seaming process 14'.

The can 100' is clamped with the lid 101' and sealed by the seaming process 14'. The sealed can is conveyed by a further rotor into the can outlet 18'.

During gassing by the gassing rotor 4', the gas is conveyed to an underside of the lid 101', in this way, it can be ensured that a residual volume of the can 100' in which no foodstuff is arranged (i.e., a headspace) is substantially filled with the gas before sealing, wherein the air originally present in the residual volume is displaced as completely as possible by the gas. In this way, if necessary, a longer shelf life of the foodstuff arranged in the can 100' can be achieved.

SUMMARY

As mentioned previously, the lid 101' is always placed on the gassing rotor 4' and is only supported by a stationary rail 15'. However, it has been determined that the gassing rotor 4' has interfering contours which complicate an efficient gassing of the lid 100' when it is united with the lid 101'. In addition, the possible variety of can shapes is limited by the shape of the recesses 17' and the shape of the lid receptacles with lid carriers 19'.

For this reason, tool change to adapt to other can formats cannot be avoided. Thereby, the current tool change times are very high.

In addition, a gassing device is known from U.S. 4,827,696 which is arranged stationary above a conveying path for filled containers. On the one hand, this gassing device has a gassing element for breaking the bubbles on the beverage and, on the other hand, a gassing rail for gassing the headspace. However, such gassing rails do not allow sufficient and efficient gassing to ensure the shelf life of the filling material.

It is therefore an object of the disclosure to provide a feeding device, a sealer, and a method for gassing which avoid the adverse effects known from the state of the art. In particular, a feeding device, a sealer and a method are to be provided which can be quickly adapted and enable an efficient gassing.

The object is met by a feeding device according to the disclosure, a sealer according to the disclosure and by the method according to the disclosure.

According to the disclosure, a feeding device is proposed for feeding a container and a, lid to a sealer and for gassing the container and the lid in a gassing area during feeding to the sealer.

The feeding device comprises a container feeder for feeding the container through the gassing area along a first feed path and a lid feeder arranged on the container feeder in such a way that a lid (by the lid feeder) can be moved through the gassing area along a (different from the first one, at least in sections) second feed path to the container and can be placed on the container in the gassing area (or at one end of the gassing area, respectively).

In addition, the feeding device comprises a gassing device arranged stationary at or in the gassing area for gassing the container and the lid in the gassing area.

The gassing device extends over the first feed path and the second feed path in such a way (or is arranged above them, respectively) that the lid and the container can be gassed (in particular separately) until the lid is brought together with the container. Preferably, the gassing device thus is (or extends) above the container feeder and the lid feeder in such a way that the lid and the container can be gassed during feeding. Thus, both lid and container can be gassed by a (single) gassing device on their feed paths. By gassing both lid and container on the feed paths, a sufficient gassing is ensured and as a consequence, a longer shelf life of the filling material is possible.

Since the gassing device is arranged stationary at the gassing area, the gassing device can in particular be arranged stationary at or above the container feeder and the lid feeder.

Due to the stationary arrangement of the gassing device above the feed paths, more efficient gassing is enabled, because the residual volume of the container can be gassed over a longer distance. In addition, no rotary feedthrough is required and thus hygiene can be increased.

Preferably, the gassing device is also arranged at an area of the feeding device where the container feeder and the lid feeder converge (i.e., the area where lid and container are guided together in the operating state before they are united and sealed in a sealing station of the sealer).

In an operating state, the container and the lid thus move through the gassing area past/below the gassing device, which is stationary, i.e., preferably fixedly mounted, immobile, or static, so that the containers and lids move at least partially separately from each other and relative to the gassing device, but the gassing device does not move, i.e., also does not move with the container or the lid.

In the context of the disclosure, "fed to the sealer" or "moved to the sealer" can be understood to mean in particular that the container or the lid is fed/moved to a working space of the sealer or to a sealing station/an arrangement of the sealer. The movements of the lid and the container and the gassing of the lid and the container take place in the operating state of the feeding device or the sealer, respectively.

The container and the lid are gassed by the gassing device before the lid is placed on the container (in particular on an opening of the container). In particular, the gas used can be an inert gas such as nitrogen ($N_2$), carbon dioxide ($CO_2$), a noble gas, or any combination of these gases. In a particularly important embodiment of the disclosure, the gas is carbon dioxide, and the container is a beverage can, or the gas is nitrogen, and the container is a canned food stuff.

Thus, the disclosure relates to the gassing of the container and the lid. It is the aim of gassing that there is no oxygen in a headspace of the container sealed with the lid. The residual oxygen in the headspace is decisive for the shelf life and flavor change of a filling product (such as a foodstuff/beverage) in an interior of the sealed container. The gassing according to the disclosure is preferably carried out up to the point where the container and lid are brought together. The headspace can be understood as a residual volume of the container in which no filling material is arranged.

In a particularly preferred embodiment of the disclosure, the gassing device can have a gassing element or a nozzle which extends from the first feed path to the second feed path. In this way, the gassing of both the lid and the can is ensured on their separate feed paths by a single gassing element. Preferably, the gassing device can comprise a plurality of gassing channels which extend from the first feed path to the second feed path, in particular extend above the first feed path and the second feed path. The gassing channels can comprise a gas inlet by which the gas is provided. In addition, the gassing channels can also be separated from each other by webs and opened downwards. In this way, the gas can be guided through the webs from the gas inlet to the second feed path, wherein the gas is guided through the openings downward to the first and second feed path. In addition, the gassing channels can be combined in one (single) nozzle, which has a common gas inlet.

In an embodiment of the disclosure, the container feeder can comprise a transport belt on which transport belt the container can be moved along the first feed path (in particular by a moving device), in particular can be moved to the sealer, especially can be moved along a transport path from a container dispenser, such as a filling device, to the sealer.

In particularly preferred embodiments, the gassing device can be arranged on, in particular above, the transport belt in such a way that the container can be gassed during the movement over the transport belt. In addition, the transport belt can be arranged and designed in such a Way that the first feed path runs linearly.

In addition, the gassing device can comprise a headspace gassing element which is arranged along a section of the transport belt (in particular parallel to the section of the transport belt with respect to a moving direction of the container or a length of the transport belt) in such a way that the container can be gassed by the headspace gassing element during movement over the transport belt.

Here, the headspace gassing element can be oriented in the direction of the transport belt in such a way that a headspace of the container moving past can be gassed.

In addition, the gassing device can comprise a lifting gassing element which is directed away from the transport belt, is oriented in particular following a lifting movement of the container, in such a way that an area between the container moving past and a lid which can be guided above the container (and also the headspace) can be gassed. In this case, the lifting gassing element is preferably to be understood as a static element. The orientation of the lifting gassing element (in particular a nozzle) is in the direction of the upward-moving container. In particular, the lifting gassing element can be arranged along a lifting path, in particular parallel to the lifting path, in such a way that the area between lid and container can be gassed during the lifting movement (i.e., during an upward movement of a lifting station of the sealing station). Since the lifting gassing element is directed away from the transport belt, it can be directed at the passing lid.

The headspace gassing element and the lifting gassing element can be realized via at least two separate/independent openings/nozzles. In particular, the headspace gassing element and the lifting gassing element can be formed by two independent (i.e., not connected) slot nozzles. As an alternative, the headspace gassing element and the lifting gassing element can be formed by a single slot nozzle, wherein one part of the slot nozzle is oriented in the direction of the transport belt and/or runs parallel to the section of the transport belt, and another part of the slot nozzle is directed away from the transport belt, is oriented in particular following the lifting movement of the container, in such a way that the area between the container moving past and the lid which can be guided above the container can be gassed.

The openings/nozzles, which are oriented differently as described above, can thus be oriented such that a gas flow for gassing is directed toward the transport belt or away from the transport belt.

In practice, the transport belt can be designed as a sliding belt so that the container can be moved in a sliding manner over a sliding surface of the sliding belt. In particular, the sliding belt is immobile, i.e., stationary, so that a separate moving device is preferably used which guides the container over the sliding belt.

Thus, the container moves in a sliding manner over a surface of the sliding belt. "in a sliding manner" means in particular that the container slides along the surface of the sliding belt, preferably at a constant speed. Here, a contact is thus made between a surface of the container and the surface of the sliding belt.

Particularly preferred, the moving device comprises a carrier for receiving and transporting the container and a pulling element which is connected to the carrier in such a way that the carrier can be moved alone the transport belt by a movement of the pulling element.

In addition, the container feed system can comprise a drive which is coupled to the pulling element in such a way that the pulling element can be moved by the drive (whereby the carriers are also moved).

The drive can be any drive from the state of the art that is suitable for driving the pulling element. For example, the drive can be a motor, in particular a servomotor. In particular, the pulling element can be arranged on the drive in such a way that the pilling element can be moved by the drive. The carrier is also set in motion by the movement of the pulling element. If the pulling element is a revolving pulling element, such as a revolving toothed flat belt, the container feed system preferably comprises the motor and a second motor or a deflection roller. The revolving pulling element is then set in motion by the motor and runs over the deflection roller.

Particularly preferably, however, the moving device comprises a plurality of (in particular finger-shaped) carriers, wherein the carriers are connected to the pulling element, in particular are attached directly to the pulling element. In this case, the pulling element can be a chain, a band, a rope or a belt. In particular, the carriers can be evenly distributed over the pulling element so that a plurality of containers can be effectively transported. In all embodiments of the disclosure, a (single) pulling element preferably comprises a plurality of carriers to enable a simultaneous transport of a plurality of containers.

Furthermore, embodiments are conceivable in which container guiding devices are arranged on the transport belt. For example, these can be simple transport belts which are arranged parallel to the pulling element and at a distance of the width of the transport belt and extend along the transport belt. Due to these container guiding devices, it is prevented that containers deviate from the transport belt during operation. This could happen, for example, in curves or during rapid changes in direction of the transport belt. Particularly preferably, however, the carriers according to the disclosure are shaped, in particular curved, in such a way that the containers are held in position by the carrier and consequently no corresponding container guiding devices are required.

The lid feeder can comprise a lid moving device which is movably arranged in such a way that the lid can be moved by the lid moving device. Furthermore, the lid feeder can comprise a lid guide arranged on the lid moving device by which the lid can be guided to the container during the movement by the lid moving device.

Preferably, the gassing device can be arranged on, in particular above, the lid guide (or at least an outer lid guide) in such a way that the lid can be gassed during the movement by the lid moving device. Here, the lid guide can be designed in such a way that the second feed path comprises a first section in which the lids can be guided radially (and separately from the container/i.e., not above the container) and comprises a second section in which the lids can be guided linearly and in particular above the (linearly guidable) container.

In addition, the gassing device can comprise a lid gassing element which is arranged along a section of the lid moving device (or in particular also of the lid guide) in such a way that the lid can be gassed before being placed on the container.

Preferably, the lid guide has a first guide surface and a second guide surface, wherein the lid can be arranged between the first guide surface and the second guide surface in such a way that the lid can be guided to the container by a relative movement of the lid moving device to the first guide surface and the second guide surface.

Thus, the lid can be set in motion by the lid moving device, but the direction of the lid movement is dictated by the lid guide, i.e., the first and the second guide surface. The lid is preferably supported on the lid guide/is carried by the lid guide and is not placed on the lid moving device as in the state of the art (i.e., is not carried by the lid moving device). The lid can thus be supported on the lid guide in such a way that the lid is carried by the lid guide.

The relative movement of the lid moving device to the first guide surface and the second guide surface can be understood to mean, in particular, that the first guide surface and the second guide surface are arranged stationary (i.e., immovable), wherein the lid moving device moves past the first guide surface and the second guide surface and moves the lid between the guide surfaces in this way. Preferably, the lid moving device can be moved along the first guide surface and the second guide surface, in particular can be moved between the first guide surface and the second guide surface, so that the lid can be moved between the guide surfaces.

The lid guide can comprise a support surface for carrying/supporting the lid, preferably a first and second support surface, on which/which the lid can be arranged and on/over which the lid can be moved by the lid moving device. Thus, the lid could be moved along the first and second guide surface and on the (first and second) support surface. However, inclined guide surfaces (having an angle not equal to 90° compared to a lid surface) can also function as support surfaces, so that the lid can be arranged on the inclined guide surfaces.

Particularly preferably, the lid is supported exclusively by the support surface/support surfaces or the inclined guide surfaces and is not placed on the lid moving device.

Thus, a simpler and more stable lid guide is provided in particular by a lid feeder designed in such a way. In particular, the lid no longer has to be placed on a gassing rotor but can rest on the lid guide until it is brought together with the container. Since the lid no longer rests on the gassing rotor, a greater variety of can shapes (particularly in relation to a neck area of the container) can be sealed.

In addition, the lid moving device can comprise a lid carrier. Preferably, the lid carrier is attached to the lid moving device in such a way that the lid can be received by the lid carder and moved in the lid guide by the lid carrier. Thus, the lid carrier is the part of the lid moving device by which the lid is contacted and moved.

Here, the term "can be moved in the lid guide" means in particular that the lid carrier can move the lid along the guide surfaces and over the guide surfaces or support surfaces. For this purpose, the lid carrier can be arranged in a movable manner between the first guide surface and the second guide surface (and possibly also between the first and second support surfaces).

Particularly preferably, the lid guide comprises a first rail and a second rail arranged along the first rail, in particular a second rail running parallel to the first rail. The first rail comprises the first guide surface and the second rail comprises the second guide surface in such a way that the lid can be guided to the container by (or along) the first and second rails. In addition, the first rail can comprise the first support surface and the second rail can comprise the second support surface in such a way that the lid can be guided to the container via the first and the second rails. As an alternative, the guide surfaces of the rails can also run inclined as mentioned above.

In this case, the lid carrier can be preferably moved in a recess between the first and the second rails. A recess can thus be provided between the first and the second rails in such a Way that the lid moving device (or lid carrier) can be moved by the recess to move the lid.

While the first and the second rails are preferably shaped in such a way that the lid is guided radially and thus preferably moves parallel to the lid moving device, the gassing device can be shaped in such a way that the lid is guided linearly (at least in sections) (and in particular with the container) in the gassing area of the gassing device. This has the advantage that the gassing values can be improved and the transfer to the container can be optimized.

Thus, the gassing of the lid is preferably carried out in sections by the gassing device arranged stationary on the (stationary) rails. The gassing no longer has to be carried out by a gassing rotor/the lid moving device.

In particular, the lid no longer has to be placed on a gassing rotor but can rest on the lid guide until it is brought together with the container. This has the advantage that the interfering contours from the gassing rotor are eliminated when the container rises. Thus, cost-saving and more hygienic lid moving devices (such as lid rotors) can be designed.

In particularly preferred embodiments, the gassing device is arranged to be stationary by being arranged or attached to the stationary transport belt and/or the stationary lid guide (or at least one of the rails).

In a particularly preferred embodiment of the disclosure, the transport belt is arranged and designed in such a way that the containers can be fed linearly, i.e., via the first feed path, which is designed in the form of a straight line. Preferably, the lid feeder is arranged and designed in such a way that the second feed path runs separately from the first feed path, at least in sections. This means in particular that the lids are not guided above the container in sections, but are guided above the second feed path, which preferably runs radially in the first section, and are gassed separately there by the gassing device before the lids reach the second section of the feed path, in which they are guided linearly and in particular above the container, so that they can be gassed with the container by the gassing device. For this purpose, the lid feeder and thus preferably the lid guide can comprise the first section, which is designed in such a way that the lids can be guided radially, and can comprise the second section, which is designed in such a way that the lids can be guided linearly, in particular above the container. The linear part of the lid guide can be formed in particular by the gassing device. The sections can be finned by correspondingly shaped rails.

In an embodiment of the disclosure, the gassing can be linear at least in sections, i.e., via, linearly arranged first and/or second gassing elements (such as, for example, a linear, i.e., linearly extending slot nozzle/slot-shaped opening or a plurality of linear, i.e., linearly arranged nozzles/openings).

In the gassing according to the disclosure, the gassing is not carried out via the lid star/gassing rotor, but via, the fixedly mounted/static gassing device or the gassing elements or channels listed above. Here, the gassing is preferably carried out via two separate areas, in particular with the same gassing element. On the one hand via the first gassing section, in which the headspace is gassed, and on the other hand via, the second gassing section, in which a lid space is gassed. The lid space can be understood as the space arranged around the lid.

In practice, the lid moving device can comprise a plurality of lid carriers, so that a plurality of the lids can be received by the plurality of lid carriers and can be moved by the lid guide. Preferably, the plurality of the lid carriers can be arranged distributed along a circumference of the lid moving device. Here, the plurality of lid carriers can be arranged circularly along the circumference of the lid moving device. Particularly preferably, the lid moving device is attached to a shaft and arranged rotatably about an axis by this shaft, so that the lid can be moved by a rotation of the lid moving device. Thus, the lid moving device can be a rotatable lid moving device. For this purpose, the lid moving device is preferably designed in the shape of a disk or a circular ring, and the shaft is arranged at a center point of the lid-moving device.

According to the disclosure, a lid rotor is further proposed as a lid moving device, or a lid feeder with the corresponding lid rotor. The lid rotor comprises a rotary element (by a lid shaft to which the lid rotor is preferably attached) rotatable about an axis in the circumferential direction. Here, a plurality of movement segments is arranged in a detachable manner along a circumference of the rotary element. For receiving and moving the lids, the movement segments comprise the lid carriers. For example, the movement segments can be screwed to the rotary element. If, in case of a format change of the lids (to a smaller or larger diameter), an exchange of the movement segments is necessary, these can simply be removed from the rotary element without having to exchange the entire lid rotor.

According to the disclosure, a sealer for sealing the containers with the lid is further proposed. The sealer according to the disclosure comprises the feeding device according to the disclosure. In addition, the sealer according to the disclosure can comprise an (carousel-shaped) arrangement arranged in a working space of the sealer and having a plurality of sealing stations. For feeding the containers with lids to the arrangement, the feeding device is arranged on the arrangement. In addition, the sealer comprises an outlet for sealed (with the lid) containers from the arrangement.

According to the disclosure, a method of gassing a container and a lid is also proposed. Here, the method according to the disclosure comprises providing the feeding device according to the disclosure, transporting the container by the container feeder, transporting the lid to the container by the lid feeder, and gassing the container and the lid during the transport by the stationary gassing device. Finally, the lid is placed on an opening of the container.

The gassing of the container and/or lid can comprise that the headspace of the container is gassed and/or the lid is gassed and/or an area between container and lid is gassed.

The headspace is preferably gassed by using the headspace gassing element, which is oriented in the direction of the transport belt for gassing the container moving past. For this purpose, openings or nozzles oriented in the direction of the transport belt, i.e., the plurality of openings/nozzles or the slotted nozzle, can be used.

The lid is preferably gassed by the lid gassing element which is arranged stationary along the section of the lid moving device for gassing the passing lid, so that the lid can be gassed before being placed on the container.

The area between container and lid is preferably gassed by using the lifting moving element, which is oriented away from the transport belt/is oriented following the lifting movement of the container for gassing the container and lid moving past, in particular the container performing the lifting movement. For this purpose, openings or nozzles directed away from the transport belt, i.e., the plurality of openings/nozzles or the slot nozzle, can be used.

The gassing of the headspace takes place preferably first linear, i.e. the headspace gassing element runs parallel to the (linearly arranged) transport belt/is arranged parallel to the transport belt.

The lid gassing of the lid takes place substantially simultaneously with the headspace gassing. One section of the lid gassing element can also run linearly to simplify the combining of lid and container.

After the linear area of gassing, the gassing of the area between the lid and the container takes preferably place by the lifting gassing element. Here, the container is transferred from the transport belt to the lifting station of the sealing station. In the process, the container performs the (preferably cam-controlled) lifting movement by the lifting station along the lifting path in order to feed the container to the lid from below.

As an alternative or in addition, gassing of the headspace of the container and/or the lid and/or the area between the container and the lid can be performed by using the plurality of gassing channels which enable a gassing by positioning them above the first feed path and the second feed path.

In addition, the method according to the disclosure can be carried out with the sealer according to the disclosure and can comprise that the lids and containers are transported to the arrangement and the container is sealed with the lid by one of the sealing stations.

Preferably, the lid feeder according to the disclosure guides the lids from a de-stacking device of a stack of lids until they are transferred to the container. After a de-stacking process, in which the lids are separated individually from a stack by the de-stacking device, the lid lies between the guide surfaces on the lid guide. The lid feeder can be arranged in the working space of the sealer below the de-stacking device.

The sealing of the container can comprise positioning the container on the lifting station, seaming the lid to the container with at least one seaming roll and the seaming head. Finally, the sealed container can be discharged from the working space of the sealer.

The working space is the space of the sealer in which the container is preferably sealed with the lid, in particular the space in which a seaming process takes place. Preferably, the working space is surrounded by a housing and thus delimits the working space of the sealer (and thus enables the formation of a hygiene zone).

In particular, the housing can be considered as a cladding, enclosure, casing or sheath which at least partially surrounds the working space. The housing can close off and/or shield the working space from the outside, so that an atmosphere in the working space is hygienically separated from the environment.

The sealing station can comprise a sealing head for sealing the container with the lid. The sealing head can comprise seaming means for seaming the lid to the container. The seaming means can be the seaming roll and the seaming head. The, or each sealing head can therefore comprise at least one seaming roll (particularly preferably two seaming rolls) and one seaming head. The sealing head can comprise seaming shafts or seaming roll pins rotatable about a seaming axis, wherein the seaming means is arranged at one end of the respective seaming shaft/the respective seaming roll pin (seaming head and seaming roll can therefore be rotated in particular via the respective seaming shaft/the respective seaming roll pin).

The sealer according to the disclosure or the arrangement, respectively, can further comprise the lifting station (or a plurality of lifting stations) for lifting the container. The lifting stations can be arranged in the arrangement opposite the sealing heads.

In practice, the sealer can comprise a container discharge for discharging the containers from the working space. A separation wall or a screen can be arranged between the container feeder and the container discharge which prevents a cross-contamination between incoming and outgoing containers.

The sealer according to the disclosure is preferably designed as a can sealer. Here, the container can be a can and the lid can be a can lid, which are seamed together by the can sealer. The can sealer usually has as an arrangement several similar sealing stations (of preferably sealing heads and lifting stations) arranged in a carousel shape, in which a can is sealed in each case with a can lid.

In the operating state of the can sealer, the seaming rolls with their respective seaming profile are brought into contact with a can lid flange of the can lid and a can flange of the can. By rotating the can, the seaming roll is then rotated in the circumferential direction of the can, thereby seaming the can flange with the can lid flange. For rotation of the can, the can is preferably clamped between the seaming head and the lifting station whereby the seaming head is rotated about the seaming axis by the seaming shaft.

In the context of the disclosure, the can can be understood to be a rotationally symmetrical container which is sealed by the can sealer and the associated seaming roll. A can can preferably comprise a metal, in particular aluminum or steel.

In principle, the sealer can preferably comprise at least two types of seaming rolls with preferably different seaming profiles (wherein the corresponding sealing head comprises seaming rolls of both types), so that cans can be sealed according to a double-seam principle, in which the cans are generally sealed in two stages. One type of seaming roll is responsible for each stage. The first type of seaming roll makes a pre-seam, while the second type of seaming roll completely seals the can/the package.

In the method according to the disclosure, can lids and can bodies can be brought together at a defined point before the actual seaming process. The feeding of the can lids is carried out by the lid feeder according to the disclosure, on which the can lids rest. The cans are fed by the container feeder according to the disclosure. The cans pass from the container feeder to one of the respective lifting stations (which are integrated in the arrangement), On one revolution of the arrangement, the lifting stations perform the cam-controlled lifting movement to feed the cans from below to the can lid and later to the seaming head. After a certain lifting distance, the can body thus comes into contact with the can lid.

In principle, the sealer according to the disclosure can be analogous to the can sealers already known from the state of the art but differs in the feeding device to avoid the disadvantages of the state of the art in this way.

BRIEF DESCRIPTION OF THE DRAWINGS

The disclosure will be explained in more detail hereinafter with reference to the drawings.

DETAILED DESCRIPTION

Figure 1:
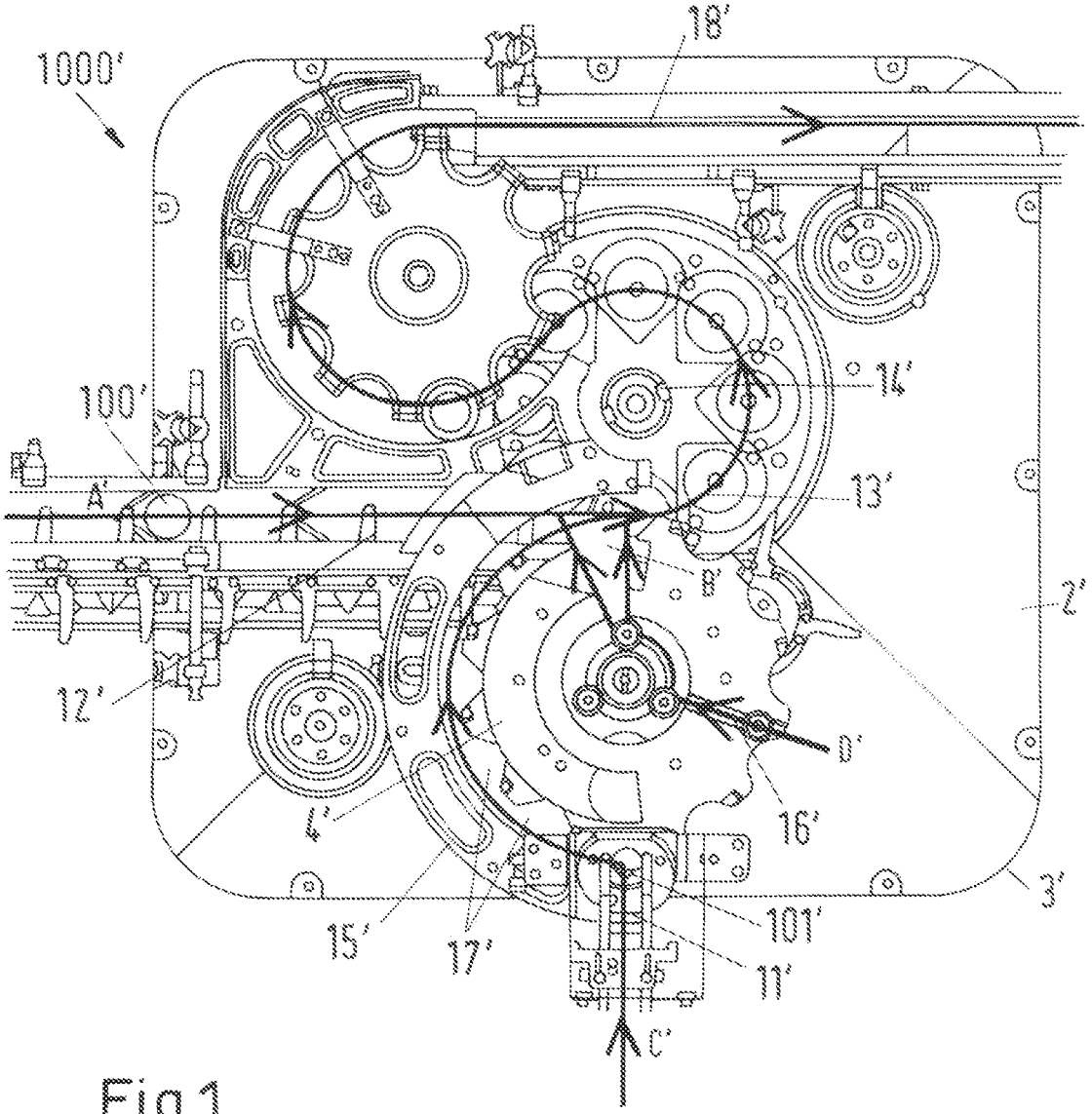
FIG. 1 illustrates atop view of a can sealer from the state of the art.
Figure 2:
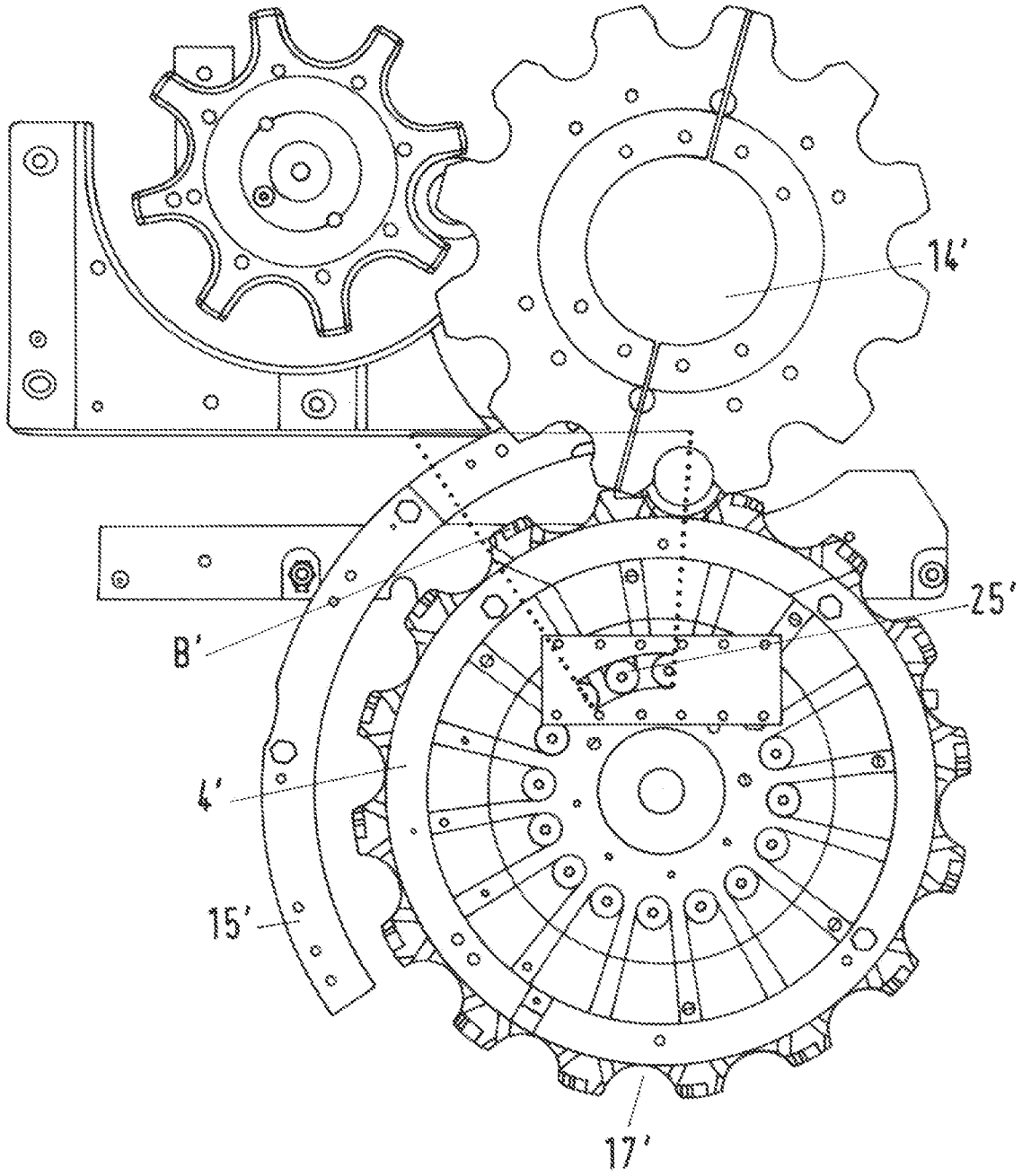
FIG. 2 illustrates a top view of a detail of a can sealer from the state of the art.

FIG. 1 and FIG. 2 have already been described above in the representation of the state of the art.

Figure 3:
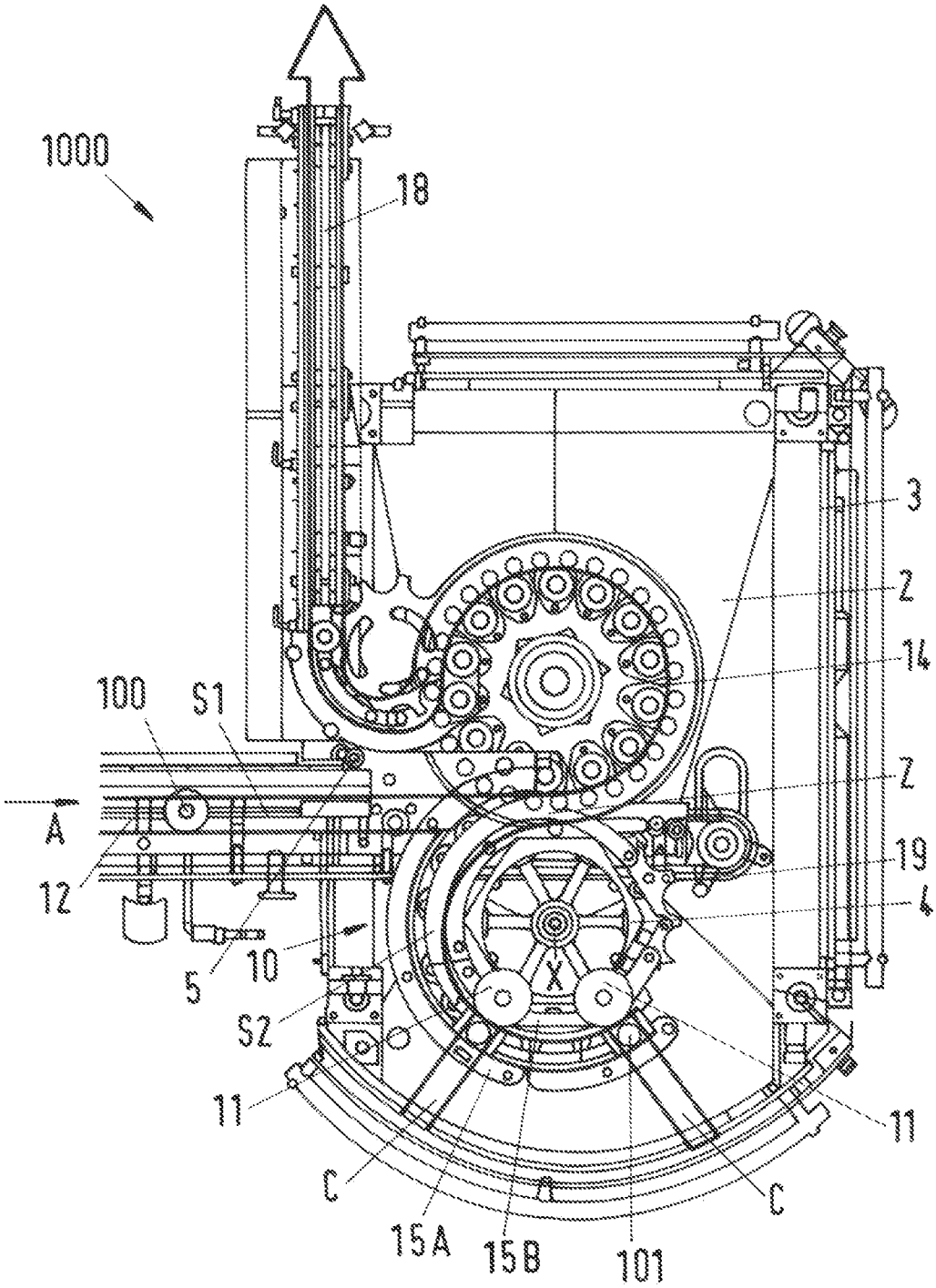
FIG. 3 illustrates a top view of a can sealer according to the disclosure.

FIG. 3 shows a top view of a can sealer 1000 according to the disclosure. In principle, the sealing process is performed in the analogous way to the state of the art, i.e., in the analogous way as described in FIGS. 1 and 2, but the gassing is no longer carried out via a gassing star on which the lids are placed and with which the cans are moved.

The can sealer 1000 according to FIG. 3 comprises two lid providing devices 11 for providing a lid 101 to a lid feeder 10 according to the disclosure, which transports the lids 101 to the can 100.

The lid feeder 10 comprises a lid moving device 4 which is movably arranged in such a way that the lid 101 can be moved to the can 100 along a second feed path S2 by the lid moving device 4. For this purpose, the lid moving device 4 is attached to a shaft and arranged to be rotatable about an axis X by this shaft, so that the lid 101 can be moved by a rotation of the lid moving device 4.

In addition, the lid feeder 10 comprises a lid guide 15A, 15B arranged on the lid moving device 4 for guiding the lid 101 to the can 100. For this purpose, the lid guide 151, 15B has a first rail 15A and a second rail 15B extending parallel to the first rail 15A, wherein the lid 101 is arranged between the rails 15A, 15B in such a way that the lid 101 is guided by the movement of the lid carrier 19 between the rails 15A, 15B in direction point Z where the lid 101 is united with the can 100 entering along a first feed path S1 in direction A from a container feeder 12.

Lid carriers 19 arranged on the lid moving device 4 are distributed and arranged on a surface of the lid moving device 4 in such a way that they can set the lids 101 arranged on the lid guide 15A, 15B in motion.

In addition, the sealer 1000 comprises a seaming process/arrangement 14 having sealing stations in the form of seaming stations for sealing the can 100 with the lid 101. The seaming process 14 is arranged in a working space 2 of the can sealer 1000 surrounded by a housing 3.

The lid 101 is introduced into the working space 2 of the can sealer 1000 along C by the lid providing device 11 and is guided to the can 100 by the lid guide 15A, 13B.

In this process, the lids 101 are placed on the rails 15A, 15B. The lids 101 are transported further by rotation of the lid moving device 4.

Then, the cans 100 with lid 101 are guided to the seaming process 14. When being fed to the seaming process 14, the can 100 and the lid 101 are gassed by a gassing device 5 arranged stationary at the lid feeder 10 and the container feeder 12. Then, the can 100 with the lid 101 is clamped and sealed by the seaming process 14. The sealed can is conveyed by a further rotor into a can outlet 18.

Figure 4:
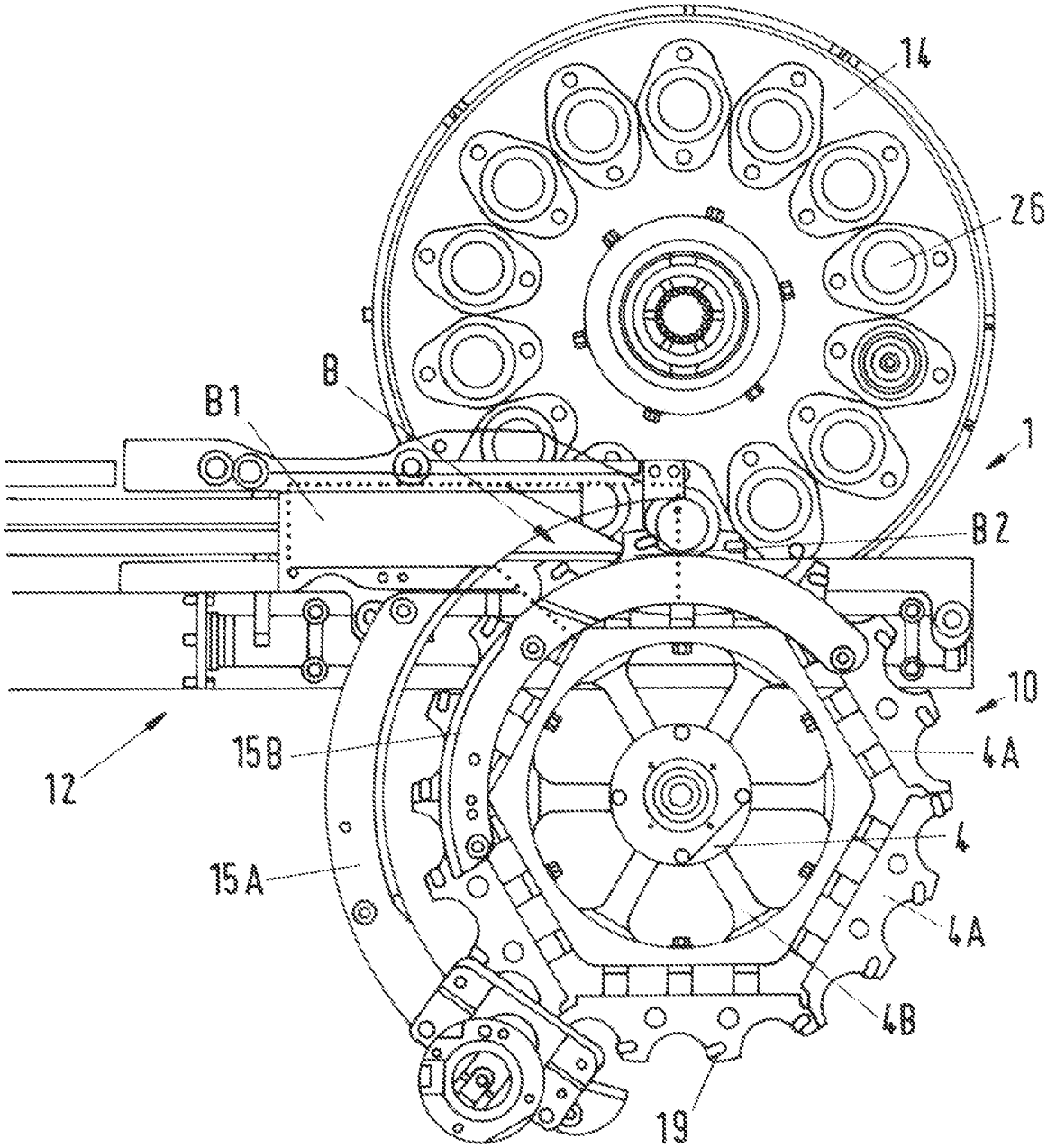
FIG. 4 illustrates a top view of a feeding device according to the disclosure.

FIG. 4 shows a top view of a feeding device 1 according to the disclosure. The feeding device 1 comprises the container feeder 12 for feeding the container to the arrangement 14 having a plurality of sealing stations 26.

In addition, the feeding device 1 comprises a lid feeder 10 arranged on the container feeder 12 in such a way that the lid can be moved to the container and can be placed onto the container in a gassing area B.

The gassing takes place in the gassing area B, wherein at least the container is gassed in area 131 and at least the lid is gassed in area B2. For this purpose, the gassing device extends over the first feed path and the second feed path.

In addition, the feeding device 1 comprises the gassing device which is arranged stationary in the gassing area B for gassing the container and the lid. Here, the gassing device is also arranged at an area of the feeding device 1 where the container feeder 12 and the lid feeder 10 converge.

The lid feeder 10 comprises a lid rotor 4 as the lid moving device 4. The lid rotor 4 comprises a rotary element 4B rotatable about an axis in a circumferential direction. Thereby, a plurality of moving, segments 4A is detachably arranged along a circumference of the rotary element 4B. For receiving and moving the lids, the moving segments 4A comprise the lid carriers 19.

Figure 5A:
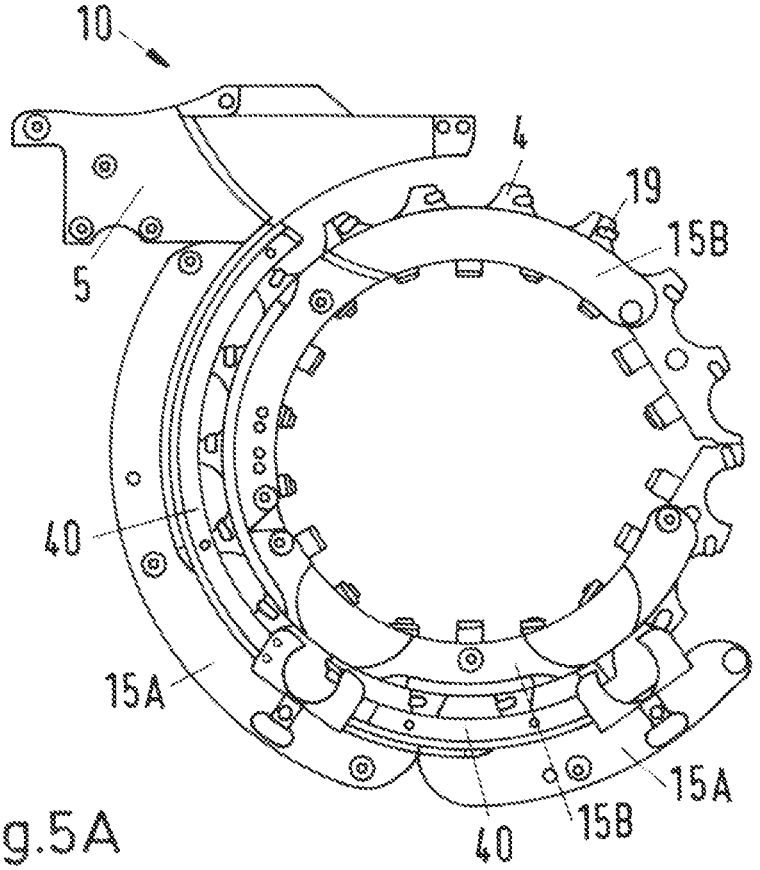
FIG. 5A illustrates a top view of a lid feeder according to the disclosure.
Figure 5B:
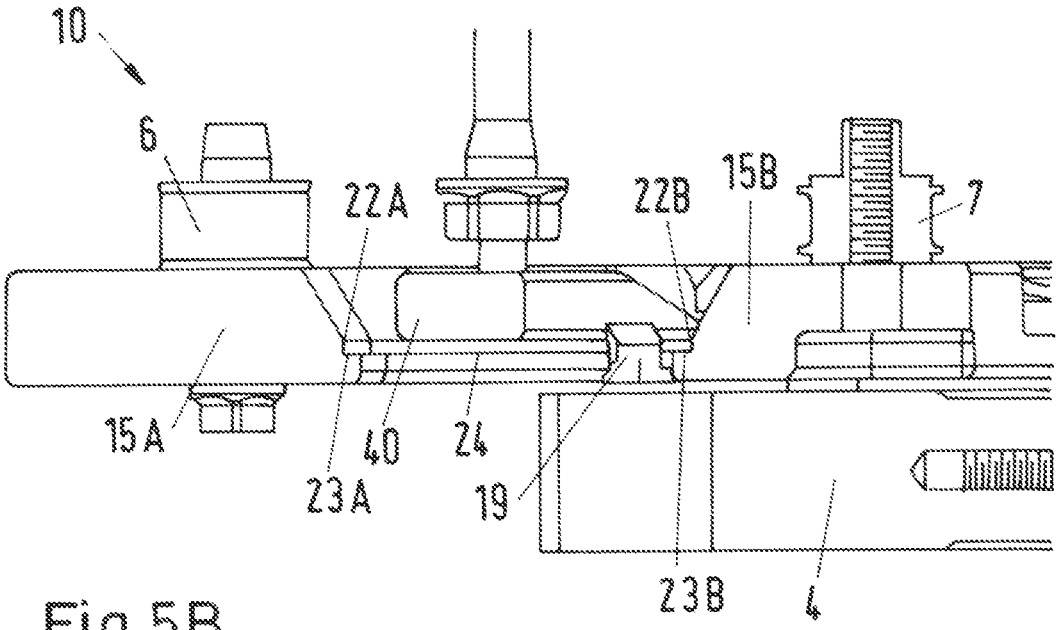
FIG. 5B illustrates a side view of a lid feeder according to the disclosure.

FIG. 5A shows a top view of the lid feeder 10 according to the disclosure and FIG. 5B shows a side view of the lid feeder 10 according to the disclosure.

The lid moving device 4 is designed in the shape of a star, wherein a lid carrier 19 is attached on each star tip for receiving and moving a lid.

The lid guide 15A, 158 comprises the first rail 15A and the second rail 158 extending parallel to the first rail 15A in sections. For this purpose, the first rail 15A and the second rail are arranged in the shape of a partial ring and above the lid moving device 4.

Here, the first rail 15A comprises the first guide surface 22A and the second rail 15B comprises the second guide surface 22B in such a way that the lid can be guided to the container by the first and the second rail 15A, 15B.

In addition, the first rail 15A comprises the first support surface 23A and the second rail 15B comprises the second rail 23B in such a way that the lid can be guided to the container via the first and the second rail 15A, 15B, i.e., can be placed on the support surfaces 23A, 23B and can be moved via them to the container.

The lid moving device 4 is arranged with upwardly directed lid carriers 19 under the first and second rail 15A, 15*b*. Here, the lid carriers 19 can be moved in a recess 24 between the first and second rail 15A, 15B.

In addition, the first and the second rail 15A, 15B are formed by a plurality of rail elements.

The first and the second rail 15A, 15B are designed with the guide and support surfaces 22A, 228, 23A, 238 such that they are open at the top. In doing so, a cleaning medium can clean the lid support (i.e., the guide and/or support surfaces) without hindrance.

Furthermore, the gassing device 5 is arranged at one end of the lid guide 15A, 15B. Here, the gassing device 5 is arranged on the side of the first (outer) rail 15A facing the arrangement 14.

While the first and second rail 15A, 15B are shaped in such a way that the lid is guided radially and thus preferably moves co-radially to the lid moving device 4, the gassing device 5 is shaped in such a way that the lid is guided linearly with the container in the gassing area of the gassing device 5. This has the advantage that the gassing values can be improved and the transfer to the container can be optimized.

However, before the lids are placed on the lid guides 15A, 15B, a de-stacking process takes place in which the lids are separated individually from a stack. Subsequently, the lid rests between lateral lid guides, i.e., the rails 15A, 15B, as described above. Then, the lid is transported further to a defined point (the point Z) by the lid moving device 4 formed as a lid star 4, with the aid of the radially arranged lid carriers 19 between the lateral lid guides 15A, 15B. The lateral lid guides 15A, 158 together form the lid track.

The lid is guided from the de-stacking device to the point Z completely resting between the rails 15A, 15B and is not placed on the lid star 4.

In addition, a hold-down device 40 is arranged above the rails 15A, 15B in such a ways that an upward movement of the lid is restricted. In this way, the lid is secured against falling out.

The rails 15A, 15B have the quick-change pins 6, 7 for an exchange during a format change.

Figure 6A:
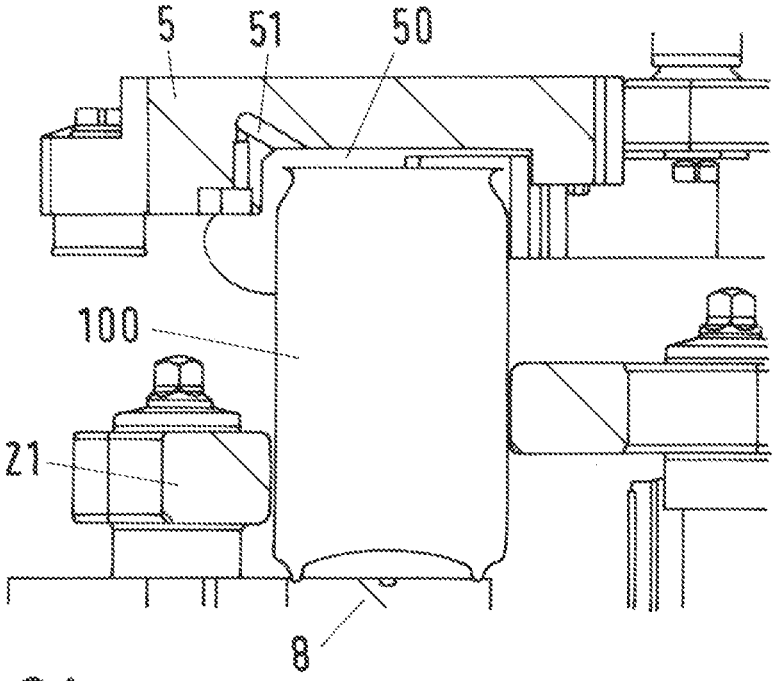
FIG. 6A illustrates a side view of a gassing device according to the disclosure with a headspace gassing element.
Figure 6B:
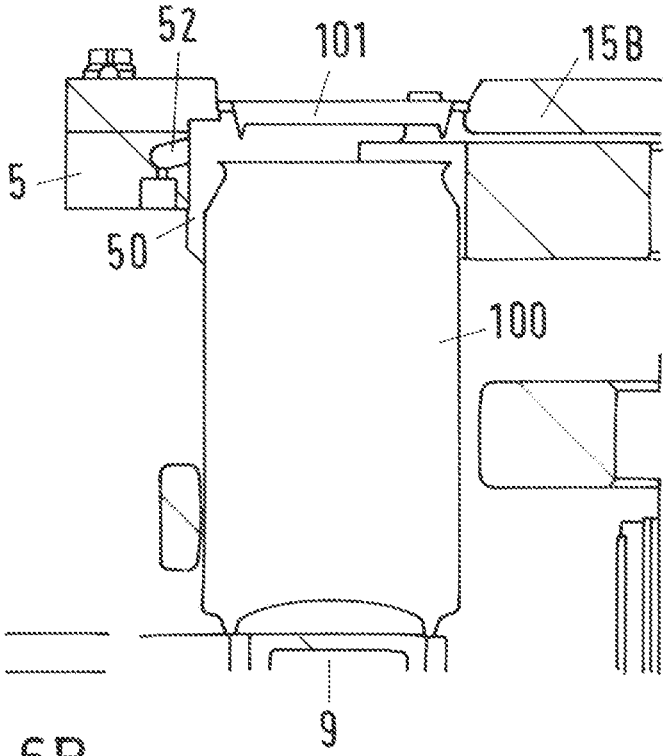
FIG. 6B illustrates a side view of a gassing device according to the disclosure with a lifting gassing element.
Figure 6C:
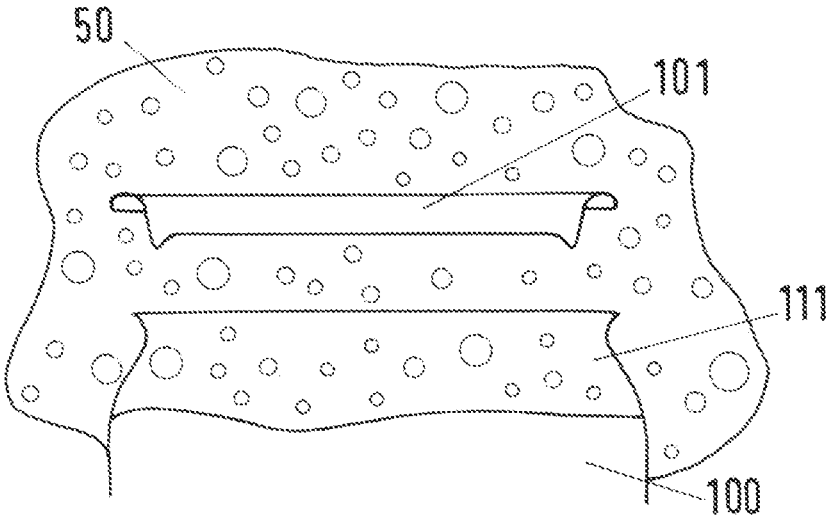
FIG. 6C illustrates a schematic view of a can with a headspace and a lid.

FIG. 6A shows a side view of a headspace gassing element 51 of the gassing device 5, FIG. 6B shows a side view of a lifting gassing element 52 of the gassing device 5 and FIG. 6*c* shows a schematic view of a can 100 with a headspace 111.

The disclosure relates to the gassing of the can and the lid 101 with a gas 50. The aim of gassing is to ensure that there is no oxygen in the headspace 111 of the sealed can. The residual oxygen in the headspace 111 is decisive for the shelf life and flavor change of the beverage. The gassing area extends up to the combining of can 100 and lid 101.

In the state of the art, the gassing nozzles are located on the gassing rotor below the lids placed on the gassing rotor. As a result, lids and gassing nozzles have no relative speed to each other. However, the gassing device 5 is arranged stationary in the gassing area and thus arranged stationary at the container feeder and the lid feeder. As a result, the can 100 is moved past the stationary gassing device 5 by a moving device comprising a carrier (not represented here) and has a relative speed to the gassing device 5.

The gassing device 5 according to FIG. 6A comprises the headspace gassing element 51, along which the container 100 is first guided and which is arranged along a section of the transport belt 8 and above the transport belt 8 in such a way that the can 100 can be gassed during movement over the transport belt 8. In addition, a can guide 21 is arranged along the transport belt 8.

The headspace gassing element 51 is oriented in the direction of the transport belt 8 (or in the direction of the passing can 100) in such a way that the headspace 111 of the passing can 100 can be gassed.

The gassing device 5 according to FIG. 6B comprises a lifting gassing element 52, which is arranged along a lifting path of the can 100, in particular parallel to the lifting path of the can 100, in such a way that an area between lid 101 and can 100 can be gassed during a lifting movement or during an (upward) movement by the lifting station 9.

The lid 101 is guided resting between the gassing device 5 and the second (inner) rail 15.

The cans 100 pass from the transport belt 8 of the container feeder, by which they are fed to the sealer, to one of the respective lifting stations 9, which are part of a respective sealing station of the arrangement of the sealer. There, can 100 and lid 101 are guided together, but not yet united.

Thus, the cans 100 pass from an area of the gassing device 5 in which they are gassed by the headspace gassing element 51 to an area in which they are gassed by the lifting gassing element 52. Thus, the headspace gassing element 51 and the lifting gassing element 52 gas in the area B1 according to FIG. 4, However, the headspace iii is to be exchanged by the headspace gassing element 51, whereas the lid 101 is gassed and the headspace 111 is kept constant by the lifting gassing element 52.

On one revolution of the arrangement, the lifting stations 9 perform the cam-controlled lifting movement along the lifting path to feed the cans 100 from below to the lids 101.

The headspace gassing element 51 and the lifting gassing element 52 are two separate/independent slot nozzles 51, 52, which are oriented differently as described above. As an alternative, the headspace gassing element 51 and the lifting gassing element 52 can also be designed as one continuous slot nozzle, whereby the part of the slot nozzle which is used as lifting gassing element 52 is oriented parallel to the lift.

As represented in FIGS. 3 and 4, the container feeder 12 is a linear container feeder 12 so that the transport belt 8 and thus die movement of the can 100 run linearly. As a result, the headspace gassing element 51 also runs linearly and the can 100 is gassed linearly.

In this linear gassing, the gassing is not carried out via a movable gassing device, but via the fix-mounted, static slot nozzle 51.

The slot nozzle 51 preferably starts about 400 mm before the can 100 and lid 101 are brought together. Due to this long gassing path, the gassing can take place at a low speed and there is still enough time to exchange the headspace 111.

Figure 7:
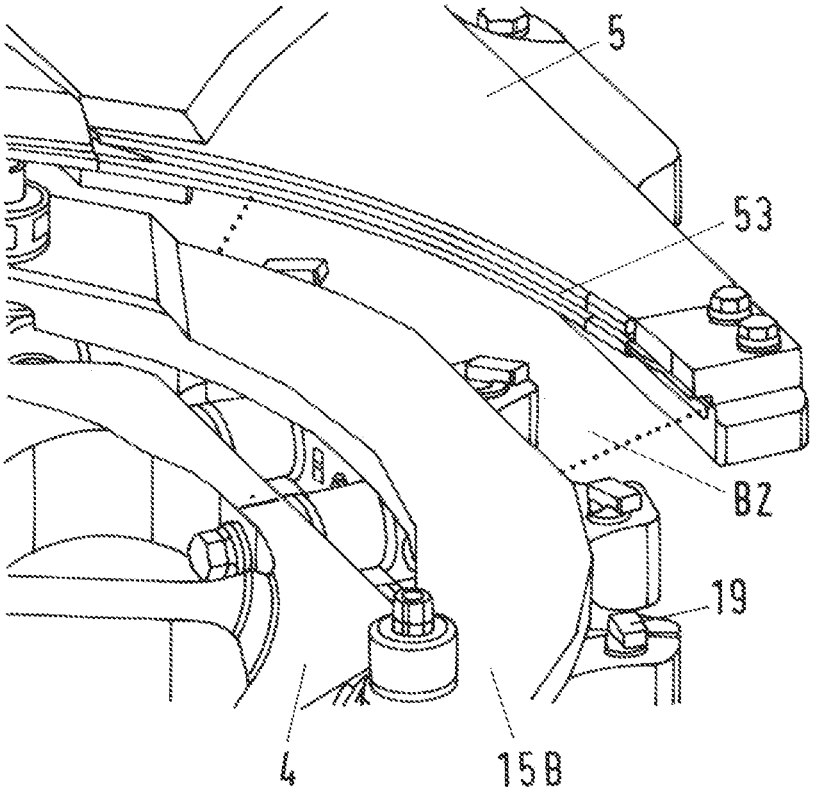
FIG. 7 illustrates a perspective view of a gassing device with a lid gassing element.

FIG. 7 shows a perspective view of the gassing device 5 with a lid gassing element 53.

The lid gassing element 53 is arranged along a section of the lid moving device 4 or along a section of the rail 15B of the lid guide, respectively, in such a way that the lid can be gassed in the area. B2 before being placed on the can.

The lid gassing element 53 is designed as a plurality of nozzles arranged side by side, whereby the lid can be gassed even better.

In all the gassing elements 51, 52, 53 described above, the mass flow rate can be defined separately for the headspace 111 and for the lid 101 with the aid of a valve.

Since, in contrast to the state of the art, a rotary feed-through is not required and a complex gassing rotor is no longer necessary, hygiene is improved, and a simpler format change is made possible. In addition, the lid no longer has to be placed on the gassing rotor, which enables an improved lid guidance and a reduction in interfering contours when rising with the lifting station 9. Due to the targeted gassing by the different gassing elements and gassing areas, a lower gas consumption is possible, and the gassing can be optimized for different products.

Figure 8A:
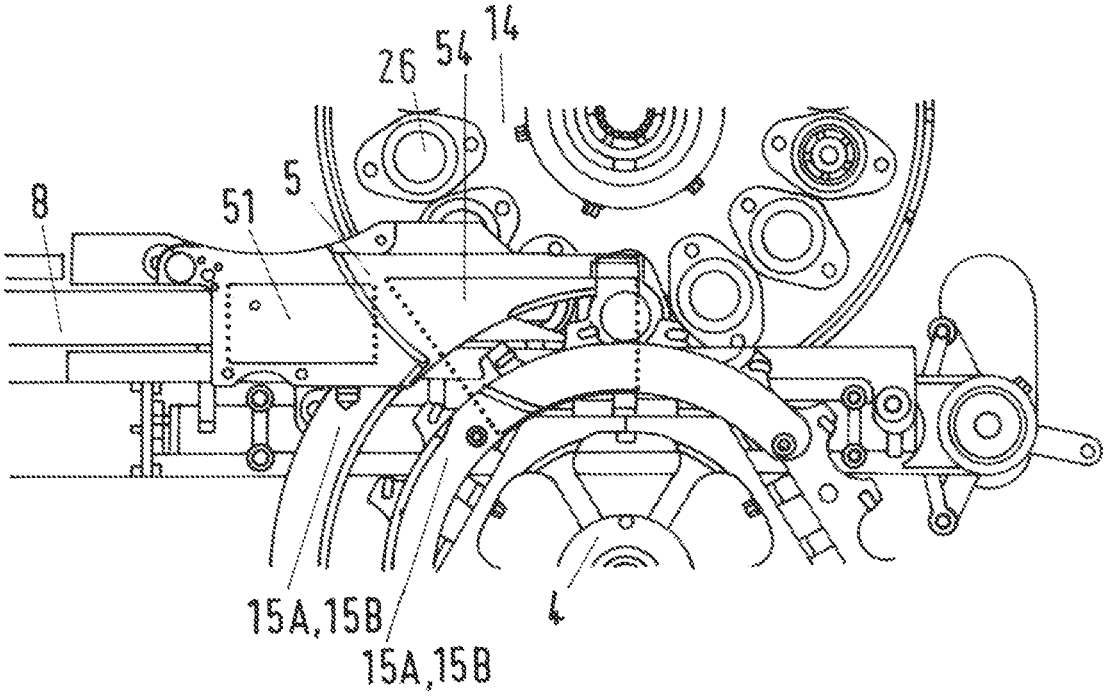
FIG. 8A illustrates a top view of a gassing device according to the disclosure with gassing channels.
Figure 8B:
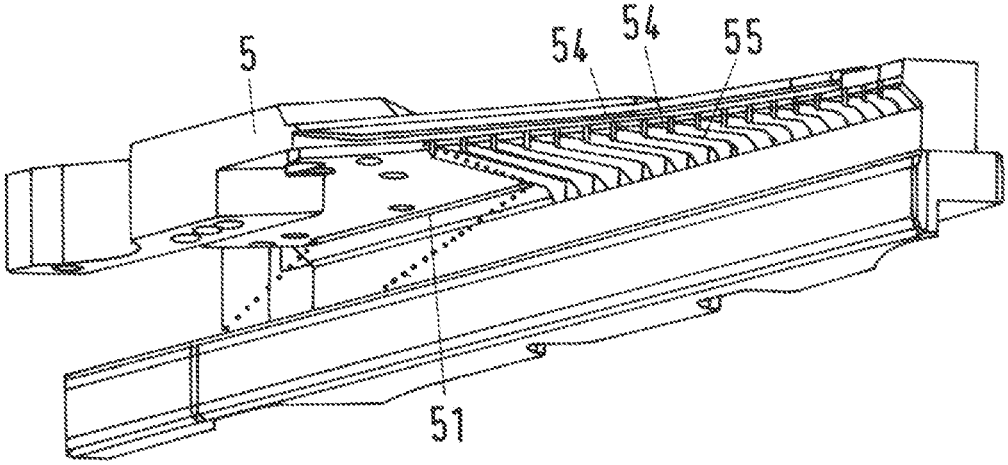
FIG. 8B illustrates a perspective view of a gassing device according to the disclosure with gassing channels.

FIGS. 8A and 813 show a preferred embodiment for a gassing device 5 according to FIG. 3 or 5A. The gassing device 5 comprises an area for gassing via the headspace gassing element 51 via fix-mounted, static nozzles. However, the main gassing is carried out via a plurality of gassing channels 54 which extend over the transport belt 8 and the outer rail 15A of the lid guide 15A, 15B and are separated from each other by webs 55. In principle, the plurality of gassing channels 54 can be designed as a single nozzle with a common gas inlet. The various gassing channels 54 are adapted in length to the radial guide of the lid.

Thus, the headspace of the can can at first only be gassed indirectly by flowing over the can and reflecting it over the lid. When the can rises, it moves into the gas flow of the gassing channels 54 and is thus additionally gassed.

The headspace gassing element 51 is optionally and preferably designed as a slot nozzle oriented in the direction of the headspace.

The disclosure is not limited to the disclosed embodiments. Other variations of the disclosed embodiments can be understood and effected by persons skilled in the art in practicing a claimed disclosure from a study of the drawings, the disclosure, and the dependent claims. In the claims, the word "comprising" does not exclude other elements or steps, and the indefinite article "a" or "an" does not exclude a plurality. The mere fact that certain measures are repeated in mutually different dependent claims does not mean that a combination of these measures cannot be advantageously used. Any reference signs in the claims should not be interpreted as limiting the scope.

The invention claimed is:

1. A feeding device for gassing a container and a lid in a gassing area during feeding to a sealer, comprising:

a container feeder configured to feed the container through the gassing area along a first feed path;

a lid feeder arranged on the container feeder in such a way that a lid is capable of being moved through the gassing area along a second feed path to the container and placed on the container at one end of the gassing area; and a gassing device arranged stationary at the gassing area configured to gas the container and the lid in the gassing area the gassing device extending over the first feed path and the second feed path in such a way that the lid and the container are capable of being gassed until the lid is brought together with the container, and the gassing device including a plurality of gassing channels which extend from the first feed path to the second feed path and are configured to simultaneously gas the container and the lid.

2. The feeding device according to claim 1, wherein a plurality of gassing channels extend together and parallel to each other from the first feed path to the second feed path.

3. The feeding device according to claim 1, wherein the container feeder comprises a transport belt on which the container is capable of being moved along the first feed path to the sealer.

4. The feeding device according to claim 3, wherein the gassing device is arranged on the transport belt in such a way that the container is capable of being gassed when moved along the transport belt.

5. The feeding device according to claim 3, wherein the transport belt is arranged and designed in such a way that the first feed path runs linearly.

6. The feeding device according to claim 3, wherein the gassing device is arranged above the transport belt in such a way that the container is capable of being gassed when moved along the transport belt.

7. The feeding device according to claim 1, wherein the lid feeder comprises a lid moving device which is movably arranged in such a way that the lid is capable of being moved by the lid moving device, and the lid feeder further comprises a lid guide arranged on the lid moving device, the lid guide configured to guide the lid to the container when being moved by the lid moving device.

8. The feeding device according to claim 7, wherein the gassing device is arranged on the lid guide in such a way that the lid is capable of being gassed when being moved by the lid moving device.

9. The feeding device according to claim 7, wherein the lid guide is designed in such a way that the second feed path comprises a first section in which the lid is capable of being guided radially and comprises a second section in which the lid is capable of being guided linearly.

10. The feeding device according to claim 7, wherein the lid guide comprises a first guide surface and a second guide surface, the lid is capable of being arranged between the first guide surface and the second guide surface in such a way that the lid is capable of being guided to the container by relative movement of the lid moving device to the first guide surface and the second guide surface.

11. The feeding device according to claim 7, wherein the lid moving device comprises a lid carrier, the lid carrier arranged on the lid moving device in such a way that the lid is capable of being received by the lid carrier and moved by the lid carrier in the lid guide.

12. The feeding device according to claim 7, wherein the lid guide is designed in such a way that the second feed path comprises a first section in which the lid is capable of being guided radially and comprises a second section in which the lid is capable of being guided above the container.

13. The feeding device according to claim 1, wherein the container feeder comprises a moving device configured to receive and transport the container over a transport belt.

14. A sealer, comprising:

a feeding device according to claim 1.

15. The sealer according to claim 14, comprising an arrangement arranged in a working space of the sealer and having a plurality of sealing stations, the feeding device configured to feed the containers with lids arranged on the arrangement; and an outlet for sealed containers from the arrangement.

16. A method of gassing a container and a lid comprising:

providing a feeding device according to claim 1;

transporting the container by the container feeder;

transporting the lid by the lid feeder to the container;

gassing the container and/or the lid during the transport with the gassing device; and placing the lid on an opening of the container.

17. The method according to claim 16, wherein the gassing of the container and/or lid comprises:

gassing a head space of the container and/or gassing a lid space and/or gassing an area between container and lid.

18. The feeding device according to claim 1, wherein the plurality of gassing channels are opened downwards in the direction of the first feed path to the second feed path.

* * * * *